United States Patent [19]

Cicin-Sain

[11] Patent Number: 4,574,704

[45] Date of Patent: Mar. 11, 1986

[54] APPARATUS FOR GUIDING A RAILROAD TRACK POSITIONING DEVICE

[75] Inventor: Ivo Cicin-Sain, Bussigny, Switzerland

[73] Assignee: Matisa Materiel Industriel S.A., Crissier, Switzerland

[21] Appl. No.: 471,243

[22] Filed: Mar. 2, 1983

[30] Foreign Application Priority Data

Mar. 24, 1982 [CH] Switzerland ..... 1800/82

[51] Int. Cl.[4] ..... E01B 35/04; E01B 33/06

[52] U.S. Cl. ..... 104/8; 33/287

[58] Field of Search ..... 104/7 R, 7 B, 8; 33/1 Q, 144, 287

[56] References Cited

U.S. PATENT DOCUMENTS

| | | | |
|---|---|---|---|
| 3,126,633 | 3/1964 | Plasser et al. | 33/1 Q |
| 3,165,073 | 1/1965 | Blix et al. | 104/8 |
| 3,292,557 | 12/1966 | Warnick | 104/8 |
| 3,345,746 | 10/1967 | Plasser et al. | 33/1 Q |
| 3,547,038 | 12/1970 | Strasser | 104/8 |
| 3,605,625 | 9/1971 | Bencsics | 104/8 |
| 3,821,932 | 7/1974 | Theurer et al. | 104/7 B |
| 3,828,440 | 8/1974 | Plasser et al. | 104/8 X |
| 4,155,176 | 5/1979 | Goel et al. | 33/1 Q X |
| 4,166,291 | 8/1979 | Shupe | 104/7 B X |

FOREIGN PATENT DOCUMENTS

| | | | |
|---|---|---|---|
| 1534092 | 6/1969 | Fed. Rep. of Germany | 104/8 |
| 2001498 | 7/1970 | Fed. Rep. of Germany | 104/8 |
| 1658338 | 9/1970 | Fed. Rep. of Germany | 104/8 |
| 503973 | 3/1976 | U.S.S.R. | 104/8 |

*Primary Examiner*—Randolph A. Reese

*Attorney, Agent, or Firm*—Robert E. Burns; Emmanuel J. Lobato; Bruce L. Adams

[57] ABSTRACT

A guidance system permits of guiding the railroad track positioning device of a track renewal and maintenance machine as the machine moves in the track working direction. To this end the curvature of a track section to be worked upon comprised in a chord of predetermined length is measured and as a function of this curvature the direction of a second chord is measured, one end of this second chord being coincident with the rear end of the section whereas its predetermined and constant length is so selected that its other end lies on the already renewed or maintained track section and shows the position of a point of this section before the renewal or maintenance works.

8 Claims, 4 Drawing Figures

APPARATUS FOR GUIDING A RAILROAD TRACK POSITIONING DEVICE

BACKGROUND OF THE INVENTION

The present invention relates to guiding a railway track positioning device installed on a track renewal machine with respect to a reference base rigid with the machine.

Generally, in railway track renewal or maintenance works such as ballast cleaning operations, the new track or the track subsequent to the maintenance operations must be either laid in the position it had before the works or shifted if necessary in relation to the former position of the track in order to take proper account of track creep at certain locations with respect to the initial track laying as a consequence, for example, of a certain falling away of the ground or similar reason.

When lifting the track for example previously to a ballast-clearing or screening operation during the ballast cleaning works, the rails are subjected to forces tending to produce a certain geometrical deformation in the track. For properly lining the track the ballast must be efficiently packed, levelled and scraped. These steps are performed by several specially equipped machines. However, since lining operations cannot under all circumstances be carried out immediately after the ballast cleaning operation due to speed differences between the track renewal machines and to railway traffic requirements, especially when reconditioning a single-track line, the track must be relaid after cleaning the ballast to a desired position which is either the original position or a position slightly shifted in relation thereto.

The device for meeting these requirements must be incorporated in the track renewal or maintenance machine without exceeding the gage limits.

THE PRIOR ART

The methods usually implemented for lining a railway track utilize a reference base consisting of three different points, with two points located on the already lined track and one point located on the track to be lined, as disclosed in the French Patent FR No. 1,429,056. In this specific method the height of the point located on the arc of the lined track section measured in relation to the chord is determined by the two points remotest from each other and the value of the height of a second point located on the track section to be lined is determined, whereafter the track is shifted at this second point until the value of the height measured at this point assumes the desired predetermined magnitude.

The devices for carrying out the method disclosed in the above-mentioned patent FR No. 1,429,056 utilize the geometry theorem known as the "power of a point with respect to a circle". In fact, the power of a point in relation to a circle is equal to the product of segments formed by this point and the points of intersection with the circle of any secant passing through this point. The point may lie either inside or outside the circle. The point concerned is materialized by a fulcrum through which two straight lines bearing on two reference points are caused to pass. The materialization of these straight lines is obtained in a first form of embodiment by two scissor-forming rods, the fulcrum lying on the inner side of the arc, the length of the two rods being so calculated that their four ends bear on the track arc and the arc is properly lined. One rod bears on the still non-lined arc end and on an intermediate, already lined point, while the second rod bears on the other end of the already lined arc, the other end denoting the proper position of a fourth point of said arc which is brought to this position by shifting.

Another device also disclosed in the French Patent FR No. 1,429,056 is similar to the above-described device and utilizes two straight segments intersecting each other outside the arc at a fulcrum point, one segment bearing on the lined end portion of the arc and passing through a second, already lined point while the other segment bears on the non-lined arc end and an intermediate point of this straight line shows the position where the point to be lined should lie.

The other forms of embodiment proposed in the French Patent FR No. 1,429,056 are similar to those briefly set forth hereinabove, the straight lines being materialized by cords, cables or rods, the arcs being either the track center line or rails, or a virtual arc located at a predetermined distance from the track.

The chief drawback characterizing the method described in this French Patent FR No. 1,429,056 is that one of the points constituting the reference base lies on the track section to be lined, so that its position is inaccurate, and therefore the measure of the height of the third reference point and the positioning of the lined point are inaccurate.

Another inconvenience characterizing this prior art method is that the reference base extends on either side of the point to be positioned, so that its use on a railroad track relaying machine operating on the site, such as a ballast clearing and screening machine, is rather complicated.

SUMMARY OF THE INVENTION

With the present invention it is possible to avoid these various inconveniences by copying the existing track before relaying or maintaining same, which on the one hand is sufficient for a provisional lining and on the other hand permits of accelerating the final lining procedure, particularly when the existing track laying does not require any correction.

It is also possible to shift one portion of the track with respect to its former position when the shifting in one or the other direction with respect to the initial position took place accidentally.

The apparatus of the present invention is characterized notably in that since the reference base is dependent on the old track exclusively, there is a certainty that the track will not depart from its former position unless a shifting is desired in relation to this former position for compensating a shifting from the initial laying which might have occured accidentally, this shifting being obtained by introducing a factor into the function giving the direction of the straight line passing through the rear end of the chord rigid with the machine. For the same reason, carrying out the present invention is facilitated since the reference base and the positioning device lie at different locations and there are no problems to be solved as far as their lay-out on the track relaying or maintenance machine is concerned.

The point positioning after the track relaying or maintenance operations may take place in two ways, i.e. either by recording the curvature of the old track section and one point of this section is positioned after the relaying or maintenance of the section by utilizing the recorded value, so that the point lies in its former position, or alternatively, when measuring the curvature of a section of the old track this value is utilized for positioning a point located on the relayed or maintained track section comprising the point and the old track section has a constant curvature or, if said track section has a variable curvature, when a value depending on the measured curvature and on a factor taking due account of the curvature variation is used. It is this second form of embodiment that will be discussed presently.

In order to afford a clearer understanding of the invention, reference will now be made to the accompanying drawings.

THE DRAWINGS

DESCRIPTION OF THE PREFERRED EMBODIMENT

Figure 1:
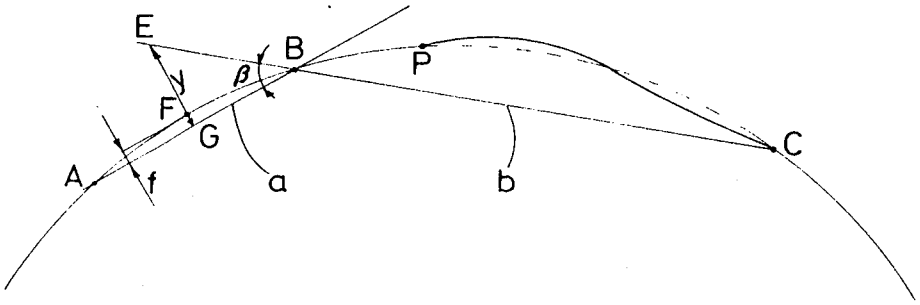
FIG. 1 is a diagram illustrating the basic principle of this invention.

In FIG. 1, AFBC denotes a circular arc showing the center line of the track, or a rail, or an equivalent arc lying at a constant and predetermined distance from the track. A and B are two points of this arc lying on, or corresponding to, the old track section. Point P is the point where the track is treated and where the track undergoes a geometric deformation. The arc PC is shown on purpose with an exaggerated deformation and illustrates the actual track position after the treatment (maintenance or relaying), while arc PC in dash lines is the desired track position. The arc points located beyond point C are already positioned.

The distance AB=a is constant and predetermined, F is the middle point of arc AB but could also be another intermediate point. The distance between points B and C is equal to b which is a constant and predetermined value. According to this invention, by measuring the height of the arc from the chord AB at point F it is possible to measure the angle $\beta$ between the two virtual chords AB and BC so that the point C lies likewise on the same circle as points A and B. After materializing the calculated position of point C, the track is shifted laterally to the calculated position.

The angle $\beta$ is determined through the following calculations in which certain mathematical terms have been simplified on the basis of the following remarks:

The radius of a track arc is usually of the order of a few hundred meters and its chordal length AB and BC is of the order of 10 to 20 meters, with maximum height of the midpoint of the arc from the chord for such values of about a few centimeters. Thus, the following simplified terms are obtained for the height f and the calculation of angle $\beta$:

$$f = \frac{a^2}{8r} \quad \text{(I)}$$

$$\tan \beta = \frac{2y}{a} \quad \text{(II)}$$

wherein

-continued $$y = \frac{a(a+b)}{4r}, \quad \text{(III)}$$

is the value of the length of segment GE of a line perpendicular to the chord AB at its midpoint, E being the point of intersection of chord BC with the line GE and r being the radius of the track arc. In fact, rather than calculating the angle $\beta$ it is sufficient to calculate the position of point E so as to determine the position of chord EBC. The position of point E is calculated from the value of the length of segment GE$=y=(2(a+b)/a)f$ (IV). The machine for carrying out the method described hereinabove takes due account of this last remark. If the curvature of arc ABC is not constant, a factor taking due account of the curvature variation must be introduced, this also applying when it is desired to shift the track with respect to its former position.

Now a clearing-screening machine for cleaning the ballast will be described which is designed for carrying out the present invention.

The ballast clearing and screening machine comprises a self-powered tractor vehicle 1 rolling on the track 2 to be cleaned and a second vehicle 3 rolling on the renewed track. The tractor vehicle 1 is provided with conveyors 4, 5 for discharging the rubbish and a screener 6 for cleaning the ballast fed by other conveyors 7, 8 and excavated by the clearing device 9. Other conveyors 10 and 11 transfer the clean ballast to a point behind the clearing device 9 where it is tamped by a tamper 12, and also behind the tamper for making up the missing ballast. Means (not shown) are provided ahead of the clearing device 9 for lifting the track and thus facilitating the clearing operation. Behind the clean ballast conveying and distributing means 11 a shifting device 14 is provided for positioning the track on the clean ballast.

The above-mentioned devices and means are well known to those conversant with the art and lend themselves to various changes without departing from the basic principles of the present invention which relates only to guiding a device for positioning the railroad track and also to a railroad track renewal or maintenance machine equipped.

A rectangular frame 16 is suspended by means of four hydraulic cylinders 17 from the chassis 18 of the self-propelled tractor vehicle 1. This frame is composed of four U-section members rigidly assembled at right angles with one another by means of squares 43 fastened to the four corners of the frame. Two track feelers 19 and 20 are secured to the two cross members 21 and 22 of frame 16 by means of two pairs of lugs 23, 24 and 25, 26, respectively. The position of these two feelers 19, 20 is fixed in relation to the frame 16 and their purpose is to materialize the reference points A and B. More particularly, the reference base consists in fact of the middle points A′ and B′ of their axis of rotation, which lie permanently on the virtual axis or center line 27 of track 2. A third track feeler 28 is mounted on a cross member 29 of frame 16 by means of a pair of lugs 30 and 31. The middle point F′ of the axis of rotation of this third feeler 28 is coincident with the middle point of arc A′, B′. Furthermore, this third feeler 28 is movable in a direction across the frame 16 so as to constantly follow the track center line. Finally, point C′ is the middle point of the track at the point of operation of the shifting device 14. The distances between points A′, B′ and B′, C′ have constant and predetermined values. The measure of the height of the arc at point F' with respect to chord A', B' is the distance from point F' to the straight line A', B' when the track feelers 19, 20, 28 contact the running rails of track 2. A spring 32 or 33 constantly urges the third feeler 28 for engagement with a pair of running rails. A mechanical multiplying device for automatically showing the position of point E' or the equivalent thereof is composed of an arm 13 pivoted to feeler 28 and cross member 29, and also to a rod 36 parallel to cross member 29 through their middle pivot points F', 34 and 35, respectively. The ends of rod 36 are pivotally connected to one end of a pair of arms 37, 38, respectively, which are pivotally connected in turn to two pivot points 39 and 40 of a pair of squares 41, 42 for positioning said arms 37, 38 to cross member 29. Pivot pins 34, 39 and 40 are stationary and the other pivot pins are movable. The positions of the fixed pivot pins 34, 39 and 40 with respect to arms 13, 37 and 38, respectively, are such that a movement f' of point F' is attended by a movement Y' of the free ends 44 and 45 of arms 37 and 38, in conformity with the above-mentioned relationship (IV). Since in this case the chord EBC is materialized by a light beam from an emitter 46 located at point E or the equivalent thereof and received by a receiver 47 at point C or the equivalent thereof, these two devices should preferably be so disposed that the light beam cannot be interrupted by an obstacle.

Figure 4:
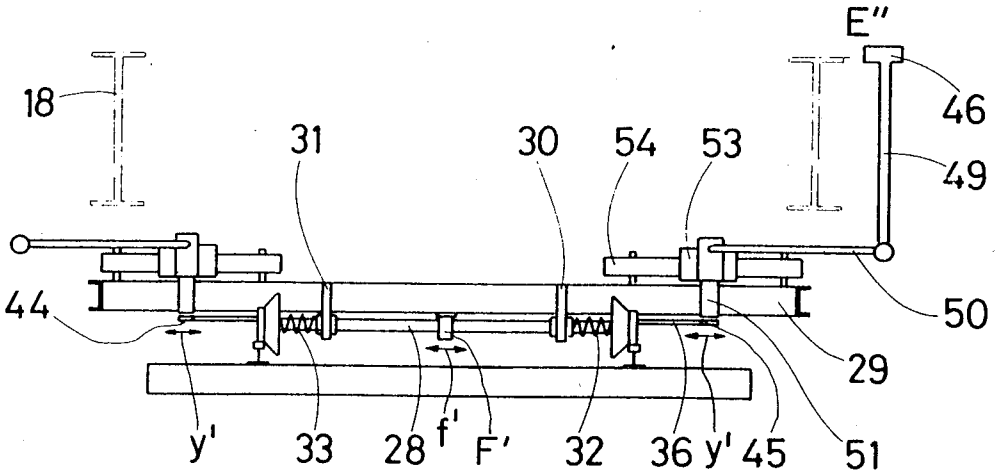
FIG. 4 is a schematic cross section on the line 4—4 in FIG. 3.
Figure 2:
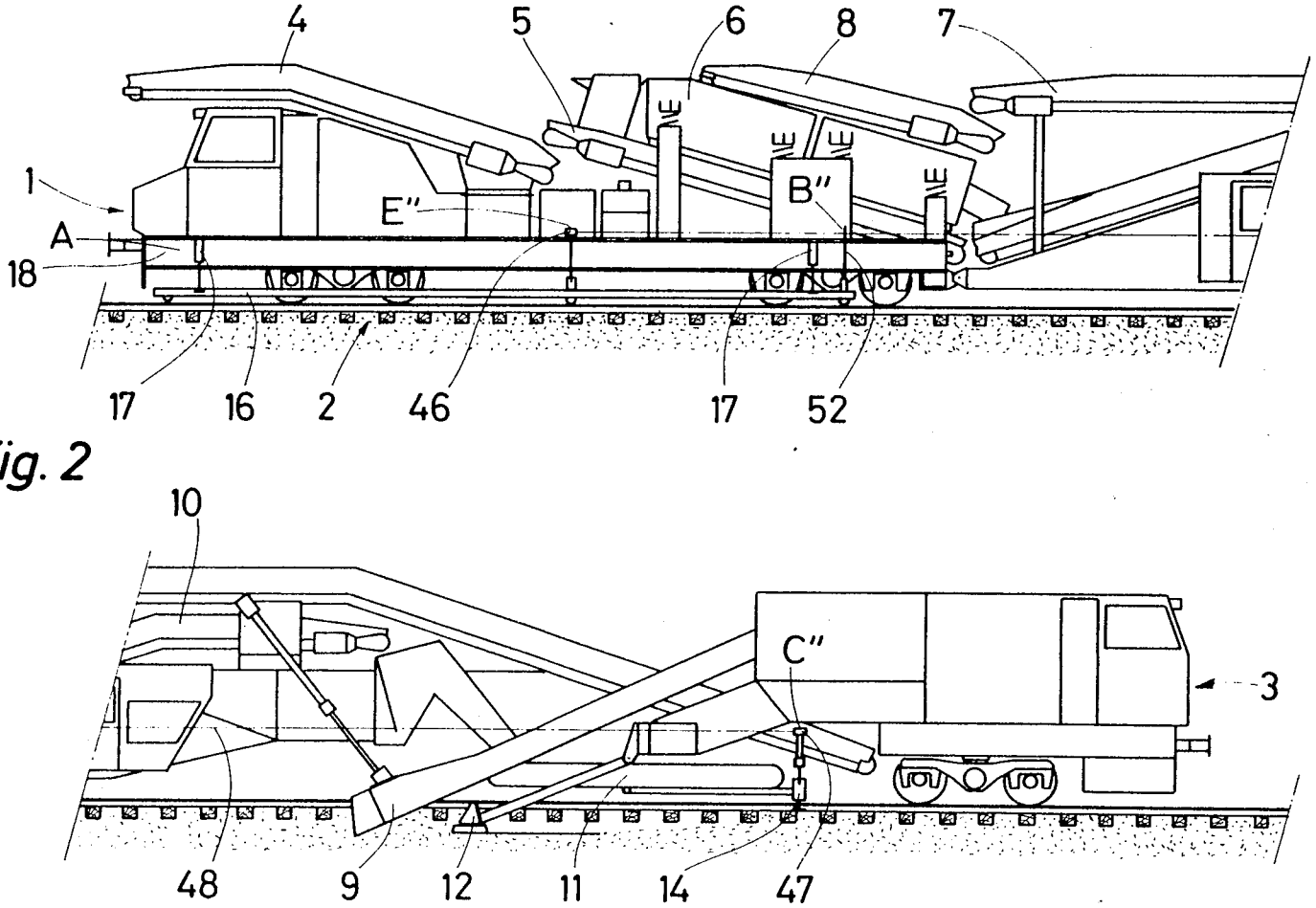
FIG. 2 is a side elevational view of a ballast clearing and screening machine in accordance with this invention.
Figure 3:
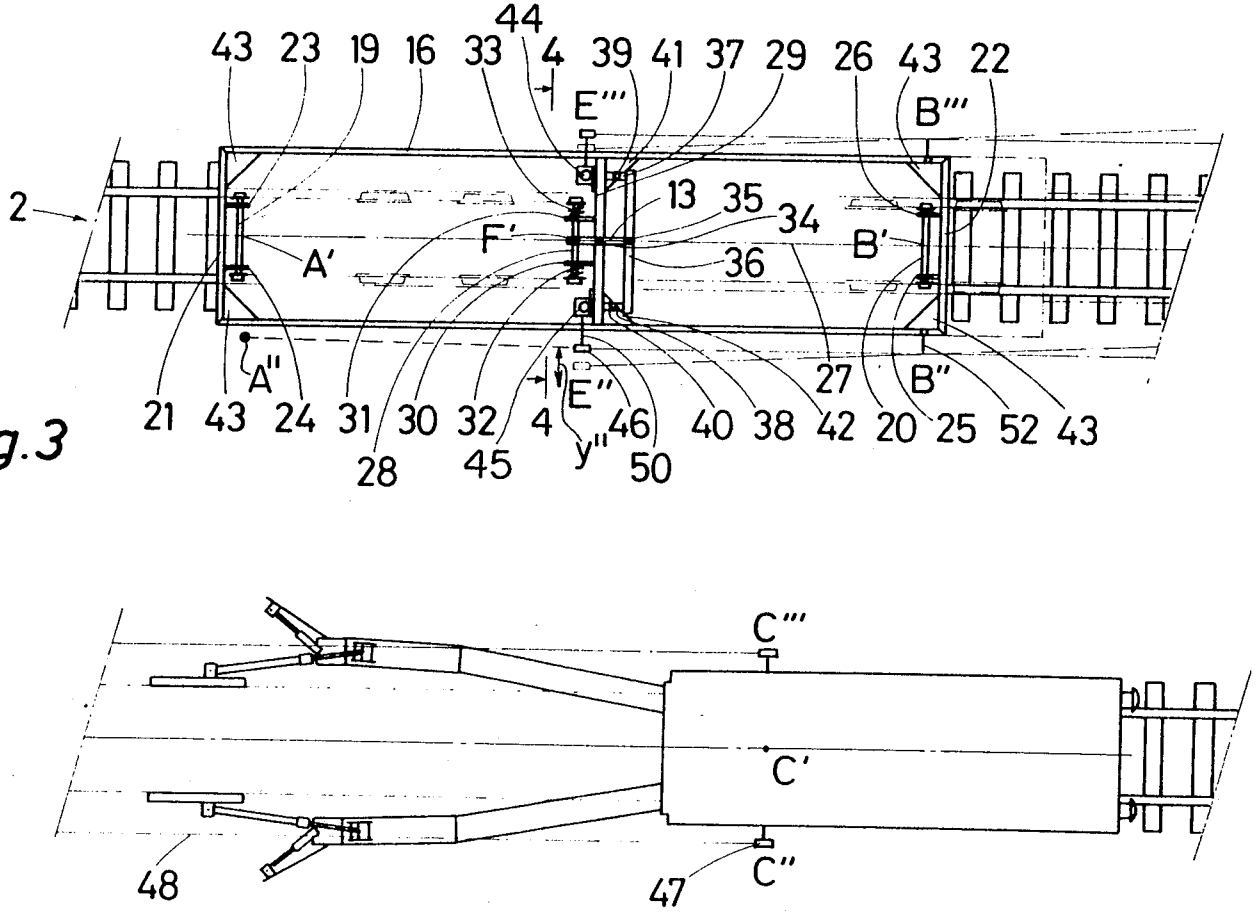
FIG. 3 is a plan view from above of the machine of FIG. 2.

Under these conditions, the emitter 46 and receiver 47 are disposed at a location spaced laterally and vertically from arc A', B', C' or, in other words, it is assumed that there is an arc A", B", C" equivalent to arc A', B', C' and obtained for example by a similarity and a translation. Point A" is not materialized since it is useless; point B" is materialized by a small vertical slit formed on a screen 52 disposed across the light beam emitted by the emitter 46 at point E", thus permitting the passage of only a thin light beam 48 corresponding to chord B", C". The emitter 46 lies at any time, inasmuch as the feelers 19, 20 and 28 engage the track running rails, in position E" spaced by a distance y" from chord A", B". The emitter 46 is supported by a vertical rod 49 (FIG. 4) fulcrumed to a horizontal arm 50 pivotally mounted on a pivot pin 51 at the end 45 of arm 38. This pivot pin 51 is guided at its upper end by a slide block 53 movable along a slideway 54 fastened to cross member 29. The pivotal mounting of rod 49 and arm 50 permits retracting the emitter within the limits of the maximum moving dimensions as determined by the frame 16. The perforated screen 52 is secured in a similar manner to the frame 16 so as to lie in a vertical plane passing through the axis of feeler 20. The receiver 47 is composed of several photosensitive elements and divided into three vertical areas. If the light beam 48 passing through the screen 52 is intercepted by elements of the central area, the track point corresponding to point C" is at the desired position; if on the other hand the beam is intercepted by elements belonging to other areas, the track must be shifted until the beam is intercepted by the central area. The receiver 47 is secured to the shifting device 14. When the light beam is intercepted by the elements of anyone of the external areas of receiver 47, a signal is fed to a device showing the direction and the amount of shift to be impressed to the track for laying the track in the proper position.

The above-described device can also be used for checking the track alignment along straight track sections, in which case points E", B" and C" should be aligned and parallel to the track. The emitter 46, receiver 47 and screen 52 may be installed on one or the other side of the machine. If desired, these component elements may be disposed on both sides (E''', B''', C''',) since they also provide a useful information as to whether they do not protrude beyond the limits of the maximum moving dimensions or detect the presence of a foreign body; in fact, if an obstacle happens to intercept the light beam between the emitter and receiver, a sound signal is produced and the machine operation is stopped.

The mechanical multiplying device described hereinabove may if desired be replaced by a hydraulic, pneumatic or electrical device.

By modifying the length y, for example, it is possible to shift the track with respect to its former position.

When the machine is running light, the frame 16 is retracted underneath the frame 18 of the tractor vehicle 1. By way of example, in a typical form of embodiment of the invention the distances between points A', B', C' may be as follows:

A'B' = 11.5 meters
A'F' = 5.25 meters
B'C' = 19 meters

It is possible to integrate a microprocessor for recording the lay-out of the former track and calculating the position of the emitter in order to either repeat the same lay-out after the renewal or maintenance works, or shift the lay-out in relation to the former position.

Though preferred forms of embodiment of the present invention have been described and illustrated herein, it will readily occur to those conversant with the art that various changes and modifications may be brought thereto without departing from the essential principles of the present invention.

I claim:

1. In a railroad track renewal or maintenance machine having a forward portion running on a portion of old track before renewal or maintenance, a rear portion running on new or relayed track and an intermediate portion spanning an intermediate space where track is being layed or relayed, said forward portion having a rectangular frame, means for guiding railroad track positioning means which comprises a first track feeler fixedly mounted on a first cross member at a forward end portion of said frame, a second track feeler fixedly mounted on a second cross member at a rearward end portion of said frame, a third track feeler mounted on a third cross member in an intermediate portion of said frame, said third track feeler being movable transversely of said frame, a light beam emitter mounted on an intermediate portion of said frame for movement transversely of said frame, said light beam emitter emitting a light beam rearwardly of said frame, motion multiplying means connecting said third track feeler with said light beam emitter for movement of said light beam emitter transversely of said frame by movement of said third track feeler transversely of said frame, a screen mounted on a rearward portion of said frame in the path of the light beam emitted by said light beam emitter and having a narrow vertical slit for passage of said light beam, a receiver mounted on said machine in the vicinity of said track positioning means for movement transversely of the machine and means connecting said receiver with said track positioning means for determining the positioning of track being layed or relayed.

2. A railroad track renewal or maintenance machine according to claim 1, in which said motion multiplying means comprises a mechanical linkage system.

3. A railroad track renewal or maintenance machine according to claim 1, in which said receiver comprises a plurality of photosensitive elements divided into three vertical areas, namely a central area and two side areas disposed respectively on opposite sides of said central area and means for showing the amount of shift to be impressed to the track for proper positioning in the event the light beam is intercepted by other than said central area.

4. In a railroad track renewal or maintenance machine having a forward portion running on old track before renewal or maintenance, a rear portion running on new or relayed track and an intermediate portion spanning an intermediate space where track is being layed or relayed, means for guiding railroad track positioning means which comprises, means carried by said forward portion for locating a first arc of old track and a first chord of predetermined constant length subtending said first arc, means for measuring the height of said arc on a first straight line perpendicular to said first chord at a point intermediate the ends of said first chord and for locating on a projection of said first straight line a first point spaced from said first chord by a distance "y" which is a function of said height, the length of said first chord and the length of a second chord of predetermined constant length, means for projecting a beam of light rearwardly from said first point along a second line extending through a second point at the rear end of said first arc and said first chord, and means carried by said rear portion for defining on said second line said second chord extending rearwardly from said second point and locating by its rear end a point in the desired position of track to be positioned in said intermediate space.

5. A railroad track renewal or maintenance machine according to claim 4, in which said means for locating said first point comprises means for determining the distance "y" according to the equation:

$$y=(a+b)/4r$$

where "a" in the length of said first chord, "b" is the length of said second chord and "r" is the radius of said first arc.

6. In a railroad track renewal or maintenance machine having a forward portion running on old track before renewal or maintenance, a rear portion running on new or relayed track and an intermediate portion spanning an intermediate space where track is being layed or relayed, means for guiding railroad track positioning means which comprises;

means carried by said forward portion for locating a first arc of old track and a first chord subtending said first arc, means on said forward portion for projecting a beam of light rearwardly from an emitter along a line extending rearwardly from the rear end of said first arc and said first chord and disposed at an angle $\beta$ to said first chord and laying out on said line a second chord of predetermined length, the angle $\beta$ being determined by the equation $$\text{Tan } \beta=2\,y/a$$

wherein $$y=a(a+b)/4r$$

where "a" is the length of said first chord, "b" the length of said second chord and "r" is the radius of said first arc, the rear end of said second chord locating the rear end of a second arc on which the layed or relayed track is to be located.

7. A railroad track renewal or maintenance machine according to claim 6, in which means for defining the line along which said beam of light is projected comprises means for locating said emitter and a perforated screen through which said beam passes.

8. A railroad track renewal or maintenance machine according to claim 7, in which said means for laying out on said line a second chord of predetermined length comprises a receiver mounted on said rear portion for movement laterally thereof.

* * * * *